US006010088A

United States Patent [19]

Shore

[11] Patent Number: 6,010,088

[45] Date of Patent: Jan. 4, 2000

[54] APPARATUS FOR CENTRALIZING RINGS BEING DEPOSITED IN AN OVERLAPPING PATTERN ON A COOLING CONVEYOR

[75] Inventor: T. Michael Shore, Princeton, Mass.

[73] Assignee: Morgan Construction Company, Worcester, Mass.

[21] Appl. No.: 09/119,868

[22] Filed: Jul. 21, 1998

[51] Int. Cl.[7] ..... B21C 47/02

[52] U.S. Cl. ..... 242/363

[58] Field of Search ..... 242/363, 360, 242/361, 361.1, 361.2, 361.3, 361.4, 361.5, 362, 362.1, 362.2, 362.3; 72/17.3, 18.1, 201

[56] References Cited

U.S. PATENT DOCUMENTS 3,460,777 8/1969 Schroder ..... 242/363
4,220,026 9/1980 Tanaka et al. .
4,664,773 5/1987 Duri .
4,914,935 4/1990 Fryer .
5,052,124 10/1991 Sekine et al. .
5,079,937 1/1992 Scholer .
5,282,524 2/1994 Kakida et al. .

*Primary Examiner*—John M. Jillions
*Attorney, Agent, or Firm*—Samuels, Gauthier & Stevens

[57] ABSTRACT

In a rolling mill where hot rolled steel rod is directed along a delivery path to a laying head which forms the rod into a continuous series of rings, and the rings are deposited in an overlapping pattern on a conveyor for transport along a continuation of the delivery path to a reforming station, the improvement comprising mounting the laying head on an underlying support structure in a manner accommodating a horizontal shifting of the direction of deposit of rings on the conveyor. Clamps releaseably secure the laying head on the support structure at any selected position of adjustment.

9 Claims, 3 Drawing Sheets

APPARATUS FOR CENTRALIZING RINGS BEING DEPOSITED IN AN OVERLAPPING PATTERN ON A COOLING CONVEYOR

BACKGROUND OF THE INVENTION

1. Field of the Invention

This invention relates generally to rolling mills producing hot rolled steel rod, and is concerned in particular with an improvement in the equipment used to form and deposit the rod in overlapping rings on a cooling conveyor.

2. Description of the Prior Art

In a typical rod rolling mill, the finished product is directed along a delivery path to a laying head where it is formed into a continuous series of rings. The rings are deposited in an overlapping pattern on a conveyor for continued transport along the delivery path to a reforming station. While on the conveyor, the rings are cooled at a controlled rate in order to achieve predetermined metallurgical properties.

Cooling is achieved by directing a gaseous coolant, typically forced air, upwardly through the overlapping ring pattern from underlying slots or nozzles. The slots or nozzles are configured and prearranged to apply a greater volume of coolant along the sides of the conveyor, where the ring density of the overlapping pattern is relatively high as compared to that at the center of the pattern.

This will achieve optimum results if the ring pattern is maintained centrally on the conveyor. However, experience has shown that different rod diameters have an effect on ring disposition on the conveyor. For example, larger diameter rings tend to lay to one side of the conveyor (to the right when looking from the laying head towards the reforming station). If the ring pattern is allowed to stray from the center of the conveyor, cooling uniformity suffers because the cooling slots or nozzles no longer perform as expected.

Numerous solutions have been proposed for controlling the position of the overlapping ring pattern on the conveyor. These include deflectors for laterally shifting the ring pattern as it is transported along the conveyor (U.S. Pat. No. 5,052,124), and mechanisms for pivotally adjusting the receiving end of the conveyor (U.S. Pat. No. 5,079,937). These attempted solutions have either failed to achieve the desired alignment of the ring pattern on the conveyor, or have caused other problems, for example scratching of the ring surfaces.

SUMMARY OF THE INVENTION

In accordance with the present invention, the laying head is mounted to accommodate a horizontal adjustment of the direction of ring deposit on the conveyor. Thus, should the ring pattern exhibit a tendency to stray from the conveyor center, a compensating adjustment can be made to the direction of ring deposit in order to return the ring pattern to its optimum centralized position. Preferably, the ring pattern on the conveyor is continuously monitored by cameras, metal detectors or the like forming part of a closed loop control system governing laying head adjustments. Releasable clamps secure the laying head at selected positions of adjustment.

These and other objects, features and advantages of the present invention will become more apparent as the description proceeds with reference to the accompanying drawings, wherein:

DESCRIPTION OF PREFERRED EMBODIMENT

Figure 1:
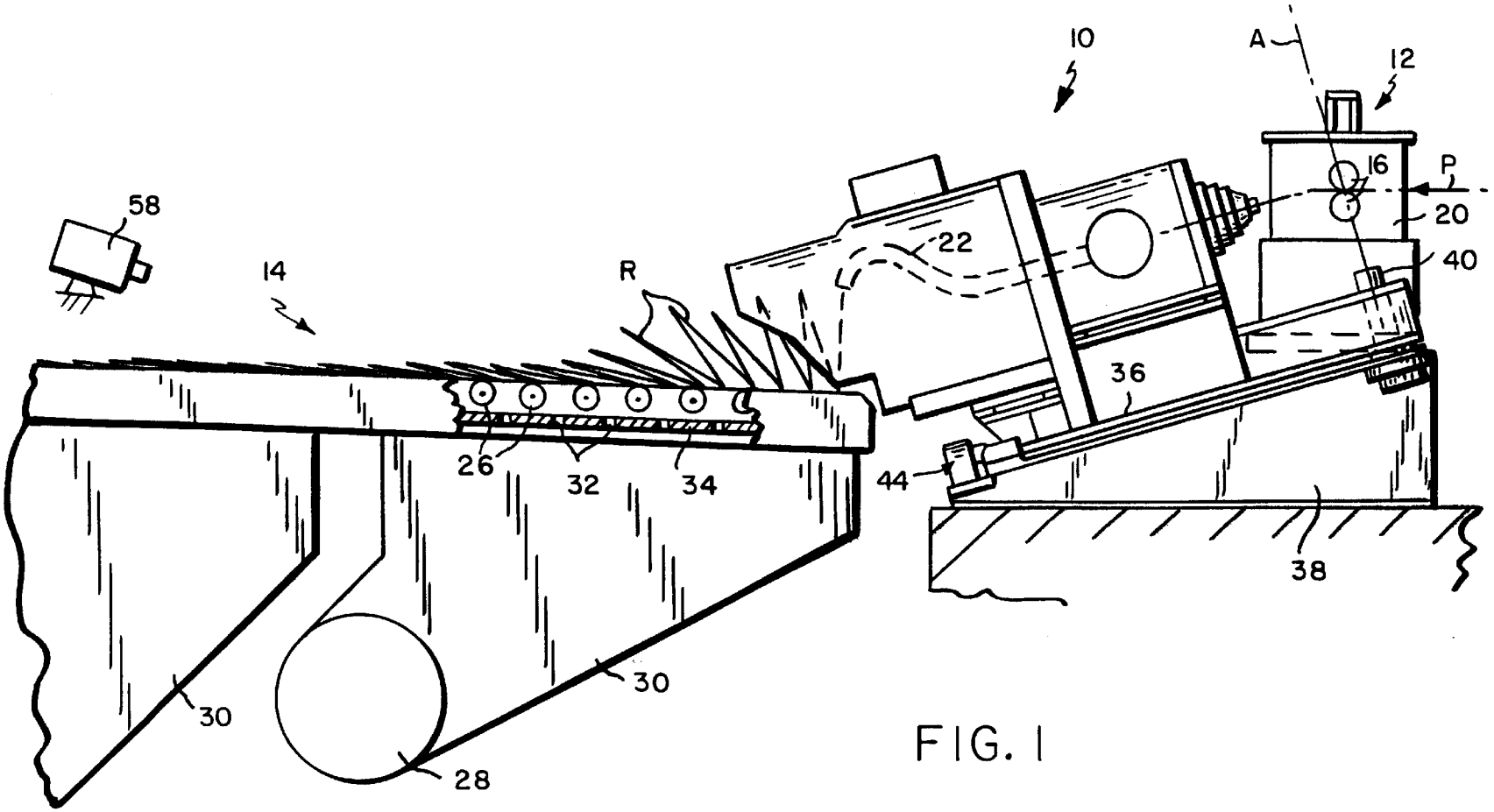
FIG. 1 is a view inside elevation of the receiving end of a cooling conveyor with an associated laying head in accordance with the present invention.

Referring now to the drawings, a laying head 10 is shown between a pinch roll unit 12 and the receiving end of the cooling conveyor 14. The pinch roll unit has a pair of pinch rolls 16 located on the delivery path "P" of hot rolled steel rod received from a rolling mill (not shown). The pinch rolls are driven in a conventional manner by a drive motor 18 and gearing (not shown) contained in a fixed housing 20.

The laying head 10 includes a three dimensionally curved laying pipe 22 rotatably driven in a conventional manner by a drive motor 24 and associated internal gearing (not shown). The pinch rolls drive the rod into and through the laying pipe, with the rotation of the laying pipe resulting in the rod being formed into a series of rings "R". As the rings exit the laying head, they are received in an overlapping pattern on the driven rollers 26 of the conveyor 14 for continued transport along a continuation of the delivery path P to a remote reforming station (not shown). While being transported on the conveyor, the rings are cooled by forced air driven by fans 28 and carried through plenum chambers 30 for upward application via nozzles or slots 32 in a deck 34 underlying the conveyor rollers.

Figure 3:
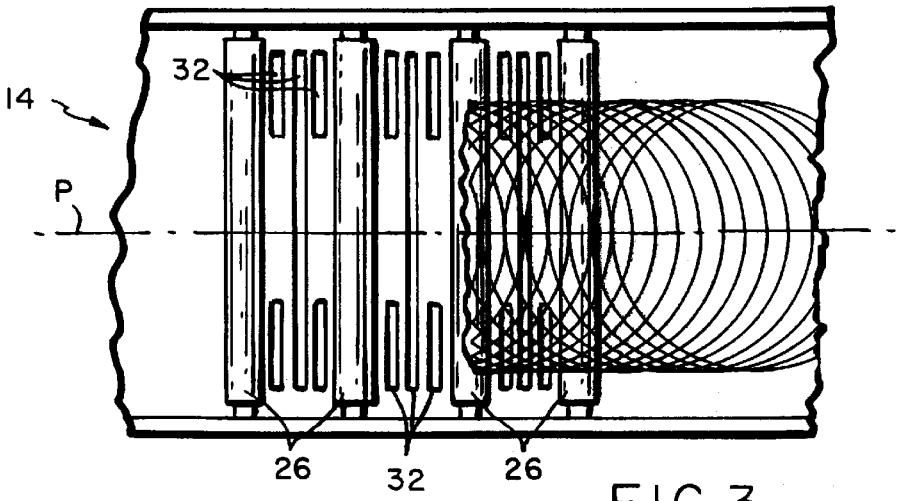
FIG. 3 is a plan view of an enlarged scale of a portion of the cooling conveyor.

As can best be seen in FIG. 3, the nozzles or slots 32 are configured and arranged to apply a greater volume of air along the conveyor edges, where the density of the overlapping pattern of rod rings is relatively great as compared to that at the conveyor center. Under ideal conditions, where the ring pattern is being transported centrally along the conveyor, as illustrated in FIG. 3, this prearrangement of slots or nozzles will achieve optimum metallurgical results by cooling the rod rings substantially uniformly.

Figure 5:
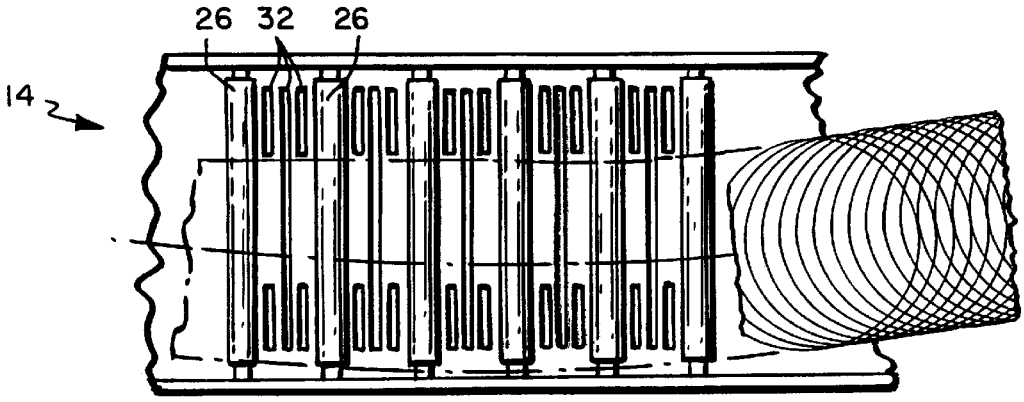
FIG. 5 is a schematic depiction of the overlapping pattern of rod rings being transported off center on the cooling conveyor.

However, as shown in FIG. 5, when different rod diameters are being rolled, the resulting overlapping ring pattern may develop a tendency to stray from the conveyor center. This in turn will upset the application of coolant, resulting in the denser concentration of rod material on one side of the conveyor being exposed to less than the optimum volume of cooling air, thereby producing non-uniform cooling.

The present invention addresses this problem by mounting the laying head 10 on a platform 36 which is in turn carried on a fixed support structure 38. A pivot shaft 40 connects the platform 36 to the underlying support structure for pivotal movement about an axis "A" which intersects the delivery path P at the nip of the pinch rolls 16.

Figure 4:
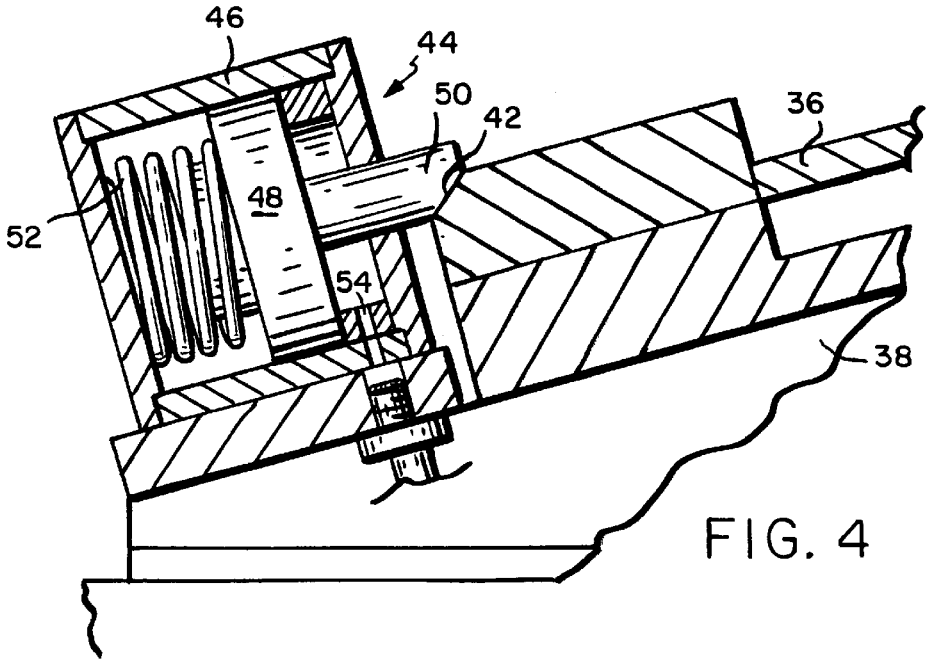
FIG. 4 is a sectional view on an enlarged scale taken along line 4—4 of FIG. 2.

Referring additionally to FIG. 4, it will be seen that the platform 36 has a bevelled forward edge 42 which circumscribes an arc having a radius extending from the pivotal axis A. A plurality of clamp assemblies 44 are mounted on the support structure 38 at spaced locations around the accurate forward edge of the platform. Each clamp assembly comprises a cylinder 46 containing a piston 48 with a rearwardly projecting bevelled nose 50 designed to coact in frictional engagement with the bevelled forward edge 42 of the platform 36 to firmly lock the platform in place on its underlying support structure 38.

Figure 2:
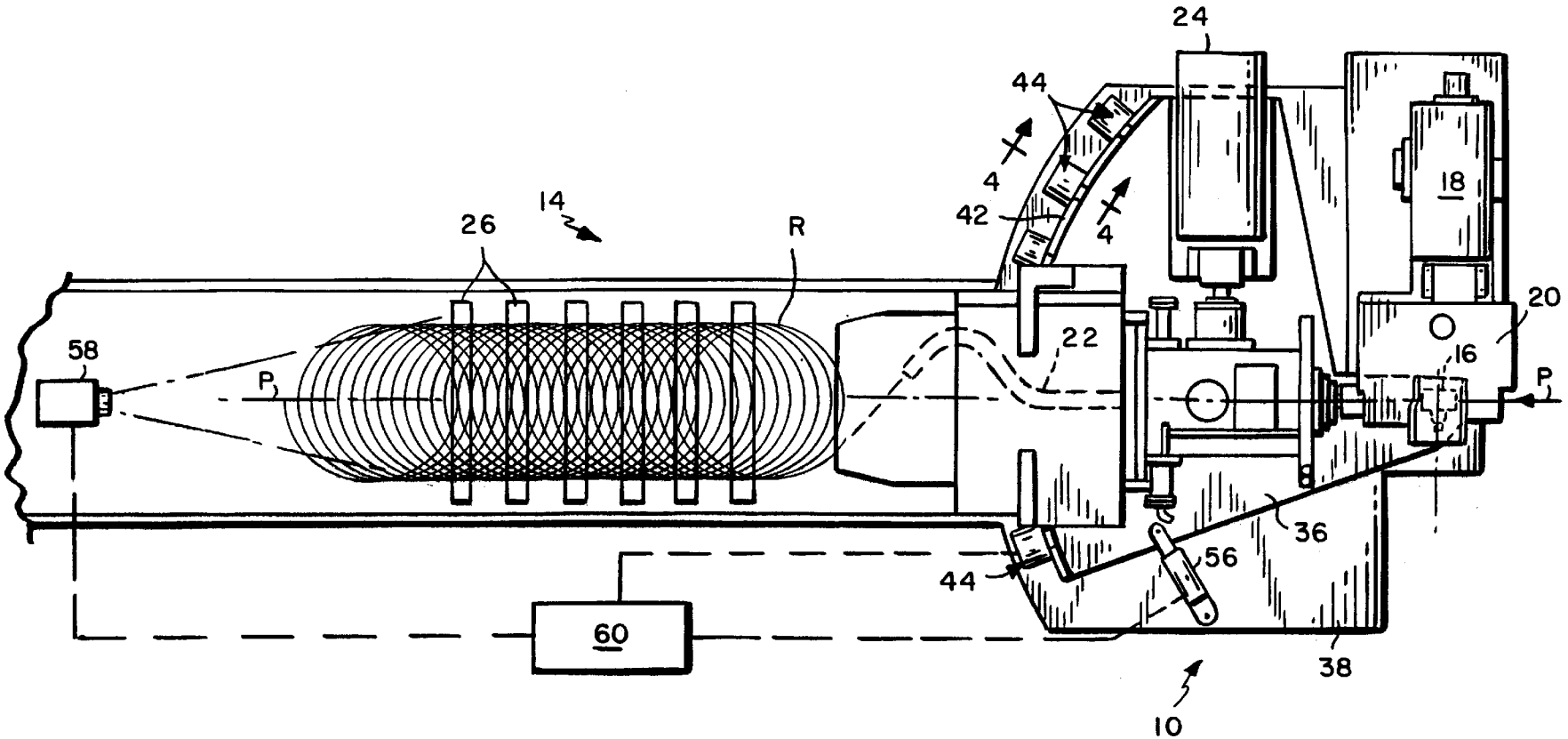
FIG. 2 is a plan view of the equipment shown in FIG. 1.

The piston 48 is yieldably urged into its engaged position by a coiled spring 52. Pressurized oil or air is introduced into the cylinder as at 54 to overcome the biasing action of the spring 52 and thereby shift the piston 48 and its bevelled nose 50 in a reverse direction, which in turn releases the platform 36 for pivotal movement about axis A. A linear actuation 56 (FIG. 2) is connected at opposite ends to the platform 36 and support structure 38 to provide the means for pivotally adjusting the platform 36 and laying head 10 about axis A.

With this arrangement, if the pattern of overlapping rings R on the conveyor exhibits a tendency to stray from the center of the conveyor, the clamp assemblies 44 can be momentarily released to accommodate a corrective pivotal adjustment of the platform 36 and laying head 10. This will horizontally shift the direction of ring deposit on the conveyor, causing the ring pattern to return to the conveyor center.

A hot metal detector or camera 58 may be employed in conjunction with an appropriate control system 60 to monitor the position of rings on the conveyor and to automatically operate the clamp assemblies 44 and linear actuator 56.

In light of the foregoing, it will now be appreciated by those skilled in the art that various changes and modifications can be made to the embodiment herein chosen for purposes of disclosure. For example, the clamp assemblies 44 and linear actuator 56 may be modified or replaced by other equivalent components designed to achieve substantially the same results. Instead of being pivotally adjustable, the laying head may be shiftable laterally along with the pinch roll unit, with appropriate upstream guides being used to insure proper delivery of the product.

It is my intention to cover these and any other changes or modifications which do not depart from the spirit and scope of the invention as defined by the claims appended hereto.

I claim:

1. In a rolling mill where hot rolled steel rod is directed along a delivery path to a laying head which forms the rod into a continuous series of rings, and the rings are deposited in an overlapping pattern on a conveyor for transport along a continuation of said delivery path to a reforming station, the improvement comprising:

a support structure underlying said laying head;

adjustment means for horizontally shifting the direction of deposit of said rings on said conveyor by correspondingly adjusting the position of said laying head on said support structure; and clamp means for releasably securing said laying head to said support structure at any selected position of adjustment.

2. The apparatus of claim 1 wherein said laying head is pivotally adjustable with respect to said support structure.

3. The apparatus of claim 2 wherein said laying head is adjustable about a pivotal axis which intersects said delivery path.

4. The apparatus of claimed 3 further comprising driven pinch rolls for propelling said rod through said laying head, said pinch rolls being arranged to frictionally engage the surface of said rod at the intersection of said pivotal axis with said delivery path.

5. The apparatus of claim 3 wherein said pinch rolls are supported at a fixed location with respect to said laying head.

6. The apparatus of claim 3 wherein said laying head has a partially curved base having a radius extending from said pivotal axis, and wherein said clamp means is engageable with said partially curved base.

7. The apparatus of claim 1 wherein said laying head is laterally adjustable with respect to said support structure.

8. The apparatus of claim 1 further comprising detection means for monitoring the position of said rings on said conveyor and for producing a control signal indicative of any deviation of said overlapping pattern from the center of said delivery path, and means responsive to said control signal for operating said adjustment means and said clamp means to correct for any such deviation.

9. In a rolling mill where hot rolled steel rod is directed along a delivery path to a laying head which forms the rod into a continuous series of rings, and the rings are deposited in an overlapping pattern on a conveyor for continued transport along said delivery path to a reforming station, the improvement comprising:

means for horizontally adjusting the position of said laying head with respect to said delivery path in order to correct for any deviation of said overlapping pattern from the center of said delivery path; and means for releasably fixing said laying head at any selected position of adjustment.

* * * * *